US008651661B2

(12) United States Patent
Haddadi

(10) Patent No.: US 8,651,661 B2
(45) Date of Patent: Feb. 18, 2014

(54) METHOD OF PREPARING AN OPHTHALMIC LENS WITH SPECIAL MACHINING OF ITS ENGAGEMENT RIDGE

(75) Inventor: Ahmed Haddadi, Charenton le Pont (FR)

(73) Assignee: Essilor International (Compagnie Generale d'Optique), Charenton le Pont (FR)

( * ) Notice: Subject to any disclaimer, the term of this patent is extended or adjusted under 35 U.S.C. 154(b) by 875 days.

(21) Appl. No.: 12/864,673

(22) PCT Filed: Jan. 9, 2009

(86) PCT No.: PCT/FR2009/000024

§ 371 (c)(1),
(2), (4) Date: Jul. 27, 2010

(87) PCT Pub. No.: WO2009/106764

PCT Pub. Date: Sep. 3, 2009

(65) Prior Publication Data

US 2010/0312573 A1 Dec. 9, 2010

(30) Foreign Application Priority Data

Jan. 28, 2008 (FR) ..... 08 00452

(51) Int. Cl.
*G02C 13/00* (2006.01)

(52) U.S. Cl.
USPC ..... 351/178

(58) Field of Classification Search
USPC ..... 351/159.01, 159.73–159.75, 178
See application file for complete search history.

(56) References Cited

U.S. PATENT DOCUMENTS 5,185,620 A * 2/1993 Cooper ..... 351/52
2001/0036794 A1 11/2001 Hatano

OTHER PUBLICATIONS

International Search Report dated Jul. 16, 2009, from corresponding PCT application.

* cited by examiner

*Primary Examiner* — James Greece
(74) *Attorney, Agent, or Firm* — Young & Thompson

(57) ABSTRACT

The invention relates to a method for preparing an ophthalmic lens (20) for mounting the same into the rim of a rimmed spectacles frame that comprises the step of acquiring a first longitudinal profile (27) of a groove of said rim, the step of blocking the lens in a holding means, and the step of trimming the ophthalmic lens using trimming means, during which the holding and trimming means are driven so that the ophthalmic lens is trimmed and includes a fitting rib extending along a second longitudinal profile (25; 26) derived from the first longitudinal profile. According to the invention, the method comprises the step of determining a second longitudinal profile of a singular portion (Z1) having a reduced curvature radius. Furthermore, during the trimming step, the holding and trimming means are driven so that the section of the fitting rib is locally narrowed in terms of width and/or height in said singular portion, and/or so that the setpoint of the trimming radius is reduced in said singular portion.

27 Claims, 5 Drawing Sheets

Fig.6
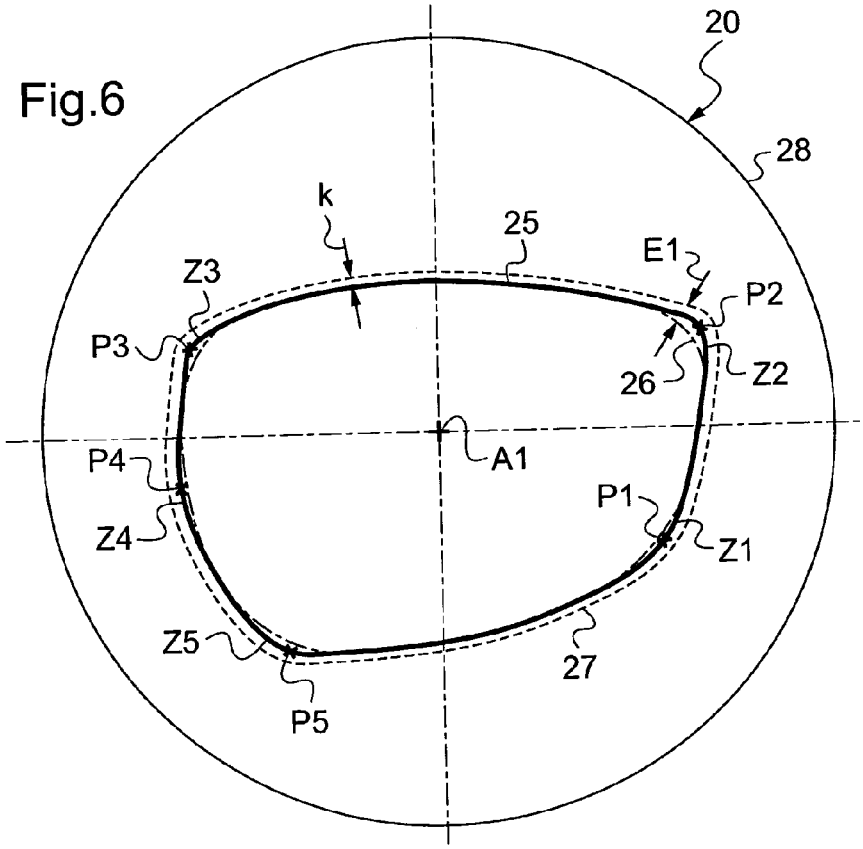
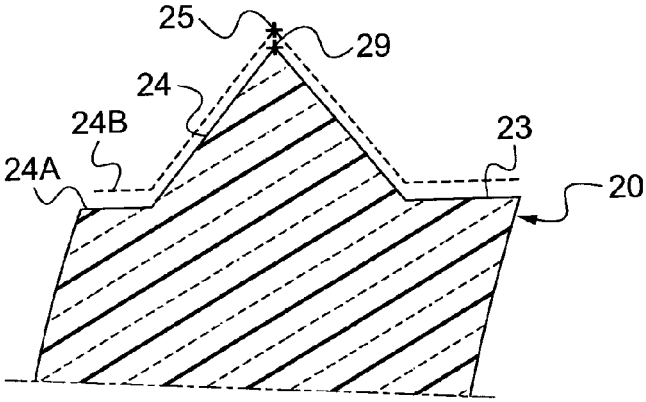
Fig.7
Fig.8
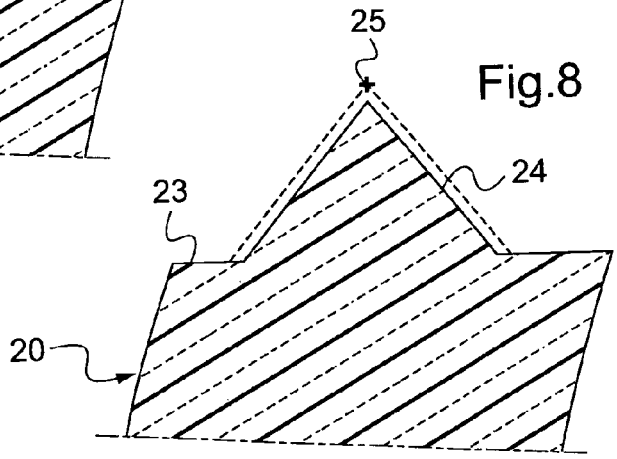

METHOD OF PREPARING AN OPHTHALMIC LENS WITH SPECIAL MACHINING OF ITS ENGAGEMENT RIDGE

TECHNICAL FIELD TO WHICH THE INVENTION APPLIES

The present invention relates in general to preparing ophthalmic lenses in order to enable them to be engaged in the surrounds of rimmed eyeglass frames.

TECHNOLOGICAL BACKGROUND

The technical portion of the profession of an optician consists in mounting a pair of correcting ophthalmic lenses on a rimmed eyeglass frame as selected by a wearer. Such mounting comprises three main operations:

- acquiring the shape of the internal outlines of the surrounds of the frame;
- centering each lens, which operation consists in positioning and orienting each lens appropriately in front of each eye of a wearer; and then
- machining each lens, which consists in cutting out or shaping its outline to the desired shape, taking account of the shapes of the surrounds and of the defined centering parameters.

In the context of the present invention, attention is given more particularly to the first and third operations referred to as acquisition and machining. The specific object of the optician is to edge the ophthalmic lens in such a manner as to enable it to be fitted mechanically and pleasingly to the shape of the corresponding surround of the selected frame, while also ensuring that the lens performs the optical function for which it is designed as well as possible.

With rimmed frames, the machining operation includes in particular a bevelling step that serves to form an engagement ridge, commonly called a bevel, on the edge face of the lens and suitable for engaging in a groove, commonly called a bezel, that runs along the inside face of the corresponding surround of the frame.

Both the acquisition and the machining operations need to be performed with particular care so as to ensure that the lens can be properly engaged in its surround, without force, and at the first attempt, i.e. without requiring a subsequent reworking.

In order to acquire the shape of the bezel, it is general practice to use an outline reader appliance that includes a feeler that picks up the shape of the bezel. Nevertheless, at the end of this feeling operation, errors are observed in the measurement of the shape of the outline. These errors are inherent to the reader appliance that may present resolution that is not sufficient, or assembly defects, or indeed that may be damaged or out of adjustment. In addition, while the bezel is being felt, any deformation of the frame (as a result of the feeler bearing against the bezel) likewise give rise to errors.

At the end of the machining operation, edging errors are also observed, such that the actual shape of the edge face of the lens does not correspond exactly to the desired shape. These errors are likewise inherent to the shaper appliance that may present resolution that is insufficient, or assembly defects, or that may include a grindwheel that is worn in shape. Furthermore, the bending deformations of the lens (due to the grindwheel bearing against the edge face of the lens while it is being machined) also give rise to errors, as do the phenomena of lenses expanding while they are being machined.

To sum up, and given the various errors and inaccuracies, a lens as machined in this way presents an outline that rarely corresponds exactly the outline of the bezel of its surround. It runs the risk of being either too big, thereby constraining the optician to perform additional and time-consuming machining of the bevel, or too small.

In order to increase the yield of lenses that are correctly edged at the first attempt, it is known to correct the defects of acquisition and shaper appliances in such a manner as to increase their resolutions and so as to enable them to take a greater number of parameters into consideration. It is also known to calibrate the appliances frequently. Nevertheless, such methods are lengthy, complex, and expensive to implement. Furthermore, the parameters actually taken into consideration are not exhaustive. As a result, the yield of lenses that are correctly edged at the first attempt is still not satisfactory.

Furthermore, a large fraction of lenses that are considered as being mountable in their surrounds are in fact slightly too big relative to their surrounds, such that once they have been engaged therein, they are mechanically under stress. As a result, such lenses are weakened and their treatment layers are likely to be damaged more quickly. Furthermore, these mechanical stresses modify the optical characteristics of lenses to some extent and that can be troublesome for their wearers.

It is also known to acquire the shapes of the bezels of the surrounds of an eyeglass frame by means of a database registry containing a plurality of records, each associated with a particular model of eyeglass frames. Nevertheless, as a result of manufacturing dispersions, it is observed that no two eyeglass frames of a given model ever present exactly the same shape. Consequently, the shapes acquired from the database are generally slightly different from the real shapes of the bezels of the particular eyeglass frame as selected by the wearer. As a result, lenses machined as a function of such acquired shapes are not always mountable in the surrounds of the selected frame, such that it is often necessary to rework the machining of their engagement ridges.

It is also known to acquire the shape of the bezel of one of the surrounds of an eyeglass frame as a function of the shape previously acquired for the bezel of the other surround of the same eyeglass frame. Nevertheless, as a result of manufacturing dispersions, it is observed that the two surrounds of an eyeglass frame are never completely symmetrical. Consequently, the shape of a bezel as derived in this way is generally slightly different from its real shape. As a result, a lens machined as a function of such a derived shape is not always mountable in the corresponding surround of the frame, such that it is often necessary to rework the machining of its engagement ridge.

OBJECT OF THE INVENTION

In order to remedy the above-mentioned drawbacks, the present invention proposes a method of preparing lenses that makes it possible not only to increase the yield of lenses that are correctly machined at the first attempt, but also to reduce the mechanical stresses to which the lenses are subjected.

More particularly, there is provided a method of preparing an ophthalmic lens for mounting in a surround of an eyeglass frame, the method comprising: an acquisition step of acquiring a first longitudinal profile of said surround; a blocking step of blocking the ophthalmic lens in support means; and an edging step of edging the ophthalmic lens by shaper means, during which the support means and/or the shaper means are controlled in such a manner that the ophthalmic lens is edged to have an engagement ridge on its edge face that is generally profiled with a desired section and that extends along a second longitudinal profile that is derived from the first longitudinal profile. According to the invention, the method includes a determination step of determining at least one singular portion of the second longitudinal profile as a portion that is situated at less than 5 millimeters from or that contains a singular point at which the second longitudinal profile presents a radius of curvature that is at a minimum or less than a threshold. Furthermore, according invention, during the edging step, the support means and/or the shaper means are controlled in such a manner that the section of the engagement ridge is reduced in width and/or height over said singular portion. In a variant, during the edging step, the support means and/or the shaper means are controlled in such a manner that the second longitudinal profile is derivable from the first longitudinal profile by a mathematical relationship that, over said singular portion, differs from the remainder of the second longitudinal profile in such a manner that the mean radius of curvature of said singular portion of the second longitudinal profile is increased relative to the mean radius of curvature that said singular portion would have presented if the given mathematical relationship had been the same over said singular portion as for the remainder of the second longitudinal profile.

The errors inherent to the operation of the reader and shaper appliances are thus compensated, not by increasing the accuracy of the appliances, but by taking these errors into account during the edging of each lens in the zones of the engagement ridge that are particularly sensitive for assembling of the lens with its frame.

These particularly-sensitive zones are zones where the bevel and the surround of the frame interfere while the lens is being engaged in its surround. Specifically, they correspond to the highly curved singular portions of the second longitudinal profile, i.e. to the projecting zones of the engagement ridge that have a small radius of curvature. Consequently, paring away the projecting zones of the engagement ridge in accordance with the invention serves to facilitate engaging the lens in its surround. As a result, the interfering singular portions become so-called "free" portions that give rise to free clearance between the engagement ridge and the bezel.

The method of the invention makes it possible in particular to determine accurately the positions of these interfering singular portions.

In order to pare the engagement ridge away, it is possible locally to reduce the section of the engagement ridge of the lens in the singular portions of the second longitudinal profile. It can then be understood that the engagement ridge will be capable of engaging more deeply into the bezel of the surround in the singular portions. Consequently, if the lens has, in error, been edged with an outline that is slightly too great relative to the outline of the surround, this additional in engagement depth enables the edging error to be compensated.

In order to pare away the engagement ridge, it is also possible to calculate the shape of the second longitudinal profile in the singular portions in a special manner, so as locally to increase the radius of curvature of the second longitudinal profile in order to give rise to a reduction in its length. In this way, during the edging step, the lens is locally machined more deeply in order to give rise, on mounting the lens in the surround, to a small gap between the surround of the frame and the edge face of the lens. Consequently, if the lens has, in error, been edged with an outline that is slightly too great relative to the outline of the surround, this small gap enabling the surround to deform locally in order to compensate for the edging error.

To summarise, the localised paring away of the engagement ridge in at least one of the singular portions of the second longitudinal profile makes it possible to reduce the difficulties of engaging lenses in their surrounds.

Preferably, said determination step excludes searching for said singular portion of the second longitudinal profile as a portion that presents a "singular point" that is a geometrical singularity, i.e. an angular point or a cusp.

The term "angular point" is used to designate a point of the second longitudinal profile at which two half-tangents form an angle that is not flat. The term "cusp" is used to designate a point of the second longitudinal profile at which two half-tangents are opposite.

The search for singular portions of the second longitudinal profile is thus not based on irregularities in the shape of the second longitudinal profile, but rather on variations in the radius of curvature of said profile.

In a second implementation of the determination step, each singular portion of the second longitudinal profile is selected as a portion that is situated at less than 5 millimeters from or that contains a singular point at a distance from an axis of the ophthalmic lens passing inside the second longitudinal profile is at a maximum or greater than a threshold.

The search for highly curved zones of the second longitudinal profile is thus performed, not by analyzing variations in the radius of curvature of said profile, but rather by determining the points that are furthest from a central axis of the second profile. This axis is preferably an optical axis or a geometrical axis of the ophthalmic lens that is to be machined.

In a third implementation of the determination step, the method takes into consideration a third profile derived from the first or the second longitudinal profile in application of a given derivation rule, the third profile being distinct from said first and second longitudinal profiles and each point thereof being associated with a point of the second longitudinal profile in application of a given correspondence rule, and each singular portion of the second longitudinal profile is selected as a portion that is situated at less than 5 millimeters from or that contains a singular point for which the associated point on said third longitudinal profile is angular or presents a radius of curvature that is at a minimum or that is less than a threshold.

In this implementation, the search for highly curved zones of the second longitudinal profile is performed on the basis of a third longitudinal profile, e.g. in the form of a frame circumscribing the second longitudinal profile. The use of this third longitudinal profile serves to make it easier to identify on said profile angular points or points having a radius of curvature this is at a minimum or that is below a threshold. In this way, it is easier to situate singular points on the second longitudinal profile. It is thus also easier to identify singular portions of the second longitudinal profile where it is necessary to pare away the engagement ridge in order to facilitate assembling the lens with its frame.

According to an advantageous characteristic of the invention, for the second longitudinal profile including at least two singular portions including a first singular portion that is the closest to a temple portion of the second longitudinal profile, the support means and/or the shaper means are controlled in such a manner that the section of the engagement ridge is reduced locally in width and/or in height at least in the first singular portion and/or in such a manner that the second longitudinal profile is derived by said mathematical relationship that is different at least in the first singular portion.

The surrounds of metal eyeglass frames are generally provided, close to the temples of the frame (i.e. close to the ear branches), with cylinders that enable them to open to receive a shaped ophthalmic lens. It is observed that such cylinders give rise to discontinuity of the bezel (and thus of the first longitudinal profile) thereby giving rise to local mechanical stresses on the lens, and possibly even prevent the engagement ridge of the lens from engaging correctly in its bezel. Under such circumstances, by virtue of the invention, paring away the engagement ridge in the first singular portion enables this discontinuity to be compensated.

DETAILED DESCRIPTION OF AN EMBODIMENT

The following description with reference to the accompanying drawings, given by way of non-limiting example, makes it clear what the invention consists in and how it can be reduced to practice.

In the accompanying drawings:

FIG. 6 is a face view of a non-edged ophthalmic lens with the final outline it is to have after edging being shown thereon:

FIGS. 7 and 8 are section views of the edge faces of two ophthalmic lenses shaped using two different implementations of the method of the invention;

Figure 1:
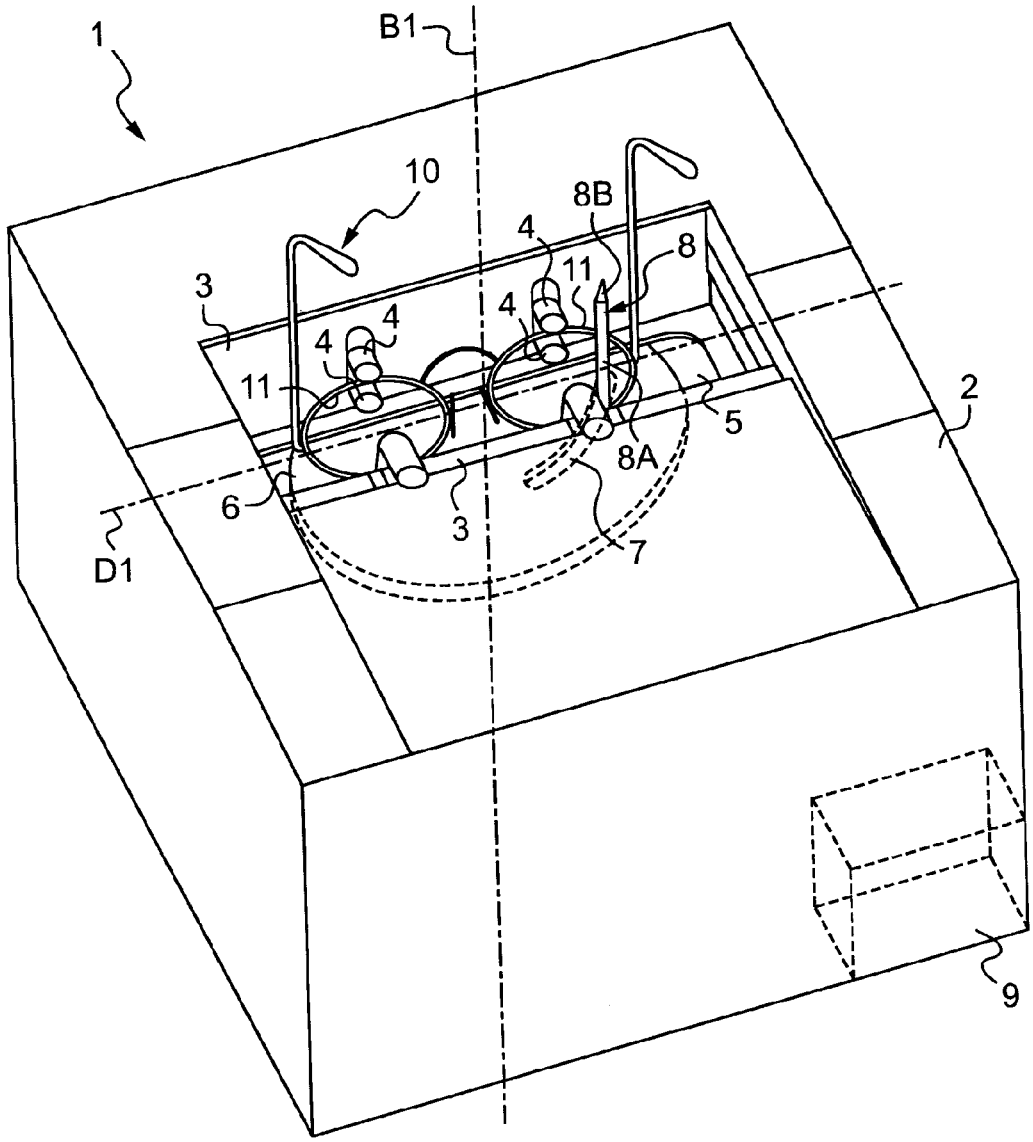
FIG. 1 is a perspective view of a reader appliance for reading the outlines of bezels of eyeglass frames.

The present invention seeks to facilitate and improve the preparation of an ophthalmic lens in order to enable it to be engaged in a surround of an eyeglass frame.

The invention thus relates more particularly to rimmed eyeglass frames 10 (FIG. 1) having two surrounds 11 that are connected together by a bridge, with each of them being fitted with a temple. Conventionally, each surround 11 has a groove running around its inside, generally of V-section, and commonly referred to as a bezel 11. The bezel extends along a first curvilinear longitudinal profile referred to as the acquired longitudinal profile 27.

This acquired longitudinal profile 27 corresponds to one of the contours of the bezel that extends over one and/or the other of the flanks of the bezel and that is substantially parallel to or coincides with the edge at the bottom of the bezel.

Each surround 11 is also closed by a cylinder having a screw passing therethrough and serving to clamp the lens in the surround so as to ensure that it is properly prevented from moving in the frame.

Figure 2:
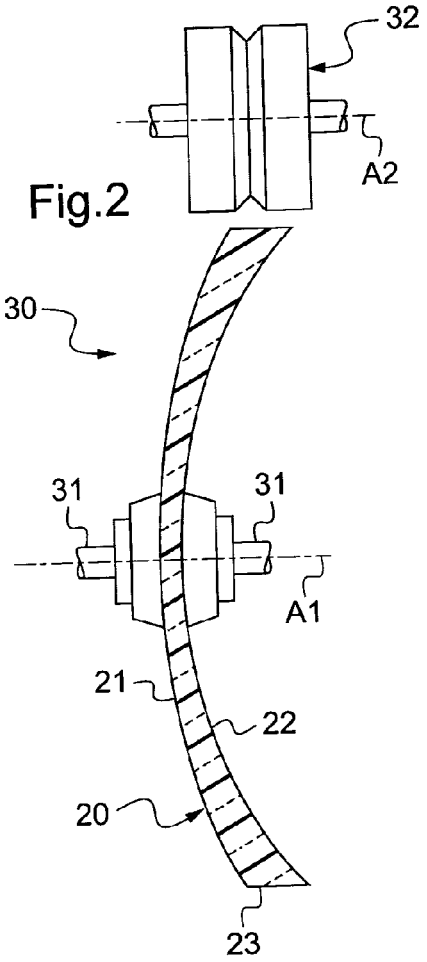
FIG. 2 is a diagrammatic view of an ophthalmic lens held in a shaper appliance provided with a beveling grindwheel.

As shown in FIG. 2, the ophthalmic lens 20 presents a convex front face 21 and a concave rear face 22, together with a peripheral edge face 23 of initial outline 28 (FIG. 6) that is generally circular.

As shown in FIGS. 6, 7, and 8, after its edge face has been machined, the ophthalmic lens 20 is to include an engagement ridge 24 that extends along a second curvilinear longitudinal profile 25; 26 that is referred to as the derived longitudinal profile, of shape that is calculated to enable the ophthalmic lens 20 to be engaged in the corresponding surround 11 of the eyeglass frame 10.

This derived longitudinal profile 25; 26 corresponds to a line that runs along the edge face 23 of the lens and meets a defined point in each cross-section of the engagement ridge 24. In this example, each of these points is defined by a rule that is uniform for all of the cross-sections of the engagement ridge 24. By way of example, the longitudinal profile 25; 26 corresponds to one of the contours of the engagement ridge 24 that extends over one and/or the other of the flanks of said engagement ridge and that is substantially parallel to or coincides with the top of the engagement ridge.

Figure 11:
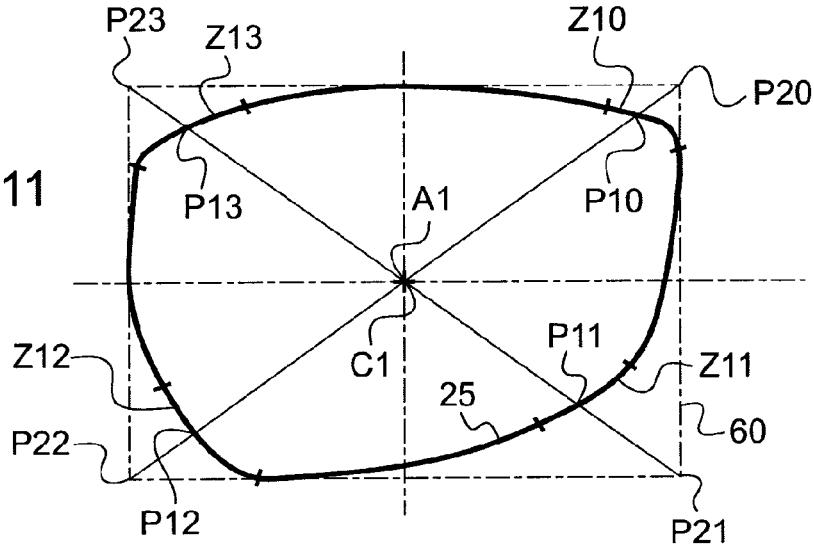
FIG. 11 is a view of the final outline of an ophthalmic lens after edging, and of a boxing frame for the final outline.

As shown in FIG. 11, a boxing frame 60 can be defined relative to the derived longitudinal profile 25.

The boxing frame 60 can be defined as being the rectangle that firstly circumscribes the orthogonal projection of the derived longitudinal profile 25 in the plane of the initial outline 28, and that secondly presents two parallel sides that are to extend horizontally when the frame 10 supporting the lens 20 is worn by the wearer.

At the intersection of its two diagonals, the boxing frame 60 presents a geometrical center C1 through which there passes an optical and geometrical central axis A1 of the lens (FIG. 2). The central axis A1 in question is substantially normal to the plane that is tangential to the front optical face 21 of the lens and that contains the point of the front optical face 21 that identifies the geometrical center C1 of the initial outline 28 when projected orthogonally onto the plane of the outline.

Device

In order to prepare such a lens, it is known to use an outline reader appliance 1, e.g. as shown in FIG. 1.

The appliance comprises a top cover 2 covering the entire appliance with the exception of a central top portion that is accessible to the user, and in which the eyeglass frame 10 is placed.

The outline reader appliance 1 serves to read the shapes of the outlines of the bezels 11 of the surrounds of the eyeglass frame 10.

For this purpose it has a set of two jaws 3, one of which is movable, the jaws being provided with movable studs 4 that serve to clamp the eyeglass frame 10 between them in order to hold it stationary.

In the space left visible by the central top opening in the cover 2, there can be seen a structure 5. A plate (not visible) is movable in translation on the structure 5 along a transfer axis D. This plate has a turntable 6 mounted to turn thereon. The turntable 6 is thus suitable for occupying two positions along the transfer axis D1, each in register with a respective one of the two surrounds of the eyeglass frame 10.

The turntable 6 possesses an axis of rotation B1 defined as being the axis normal to the front face of the turntable 6 and passing through its center. It is suitable for pivoting about said axis relative to the plate. The turntable 6 also includes an oblong slot 7 in the form of a circular arc with a feeler 8 projecting therethrough. The feeler 8 comprises a support rod 8A of axis perpendicular to the plane of the front face of the turntable 6, and at its free end, a feeler finger 8B of axis perpendicular to the axis of the support rod 8A. The feeler finger 8B serves to slide, or possibly to roll, along the bottom of the bezel in each of the two surrounds of the eyeglass frame 10, by moving along the slot 7.

The outline reader appliance 1 includes actuator means (not shown) suitable, firstly to cause the support rod 8A to slide along the slot 7 so as to modify its radial position R relative to the axis of rotation B1 of the turntable 6, secondly to vary the angular position THETA of the turntable 6 about its axis of rotation B1, and thirdly to position the feeler finger 8B of the finger 8 at a greater or lesser altitude Z relative to the plane of the front face of the turntable 6. Each point felt by the end of the feeler finger 8B of the feeler 8 is thus identified in a corresponding system of coordinates R, THETA, Z. The coordinates of such a felt point are then written $ra_i$, $thetaa_i$, $za_i$.

The outline reader appliance 1 also includes an electronic and/or computer device 9 serving firstly to control the means for actuating the outline reader appliance 1, and secondly to acquire and record the coordinates $ra_i$, $thetaa_i$, $za_i$ of the end of the feeler finger 8B of the feeler 8.

In order to prepare the ophthalmic lens 20, it is also known to make use of a shaper appliance 30 that does not form part of the present invention, per se. Such a shaper appliance, is well known to the person skilled in the art, and is described for example in document U.S. Pat. No. 6,327,790, or sold by the Applicant under the trademark Kappa CTD.

As shown in FIG. 2, such a shaper appliance generally includes support means, constituted in this example by shafts 31 for holding the ophthalmic lens 10 and for driving it in rotation about a blocking axis A1. Such a shaper appliance also includes shaper means, formed in this example by a machining tool 32 mounted to rotate about an axis of rotation A2 that is substantially parallel to the blocking axis A1, but that could equally well be inclined relative to said axis. The machining tool 32 and/or the shafts 31 are provided with two freedoms of relative movements, including a radial freedom of movement enabling the spacing between the axis of rotation A2 and the blocking axis A1 to be modified, and a freedom of movement in axial translation along an axis parallel to the blocking axis A1.

The shaper appliance 30 also includes an electronic and/or computer device (not shown) that is provided firstly with communications means for communicating with the electronic and/or computer device 9 of the outline reader appliance 1, and secondly with the means for controlling the movements of the shafts 31 and of the machining tool 32. For each angular position of the lens about the blocking axis A1, this electronic and/or computer device serves in particular to control the radial spacing between the machining tool 32 and the blocking axis A1, and also the axial position of the edge face 23 of the lens relative to the working surface of the machining tool 32.

Figure 3:
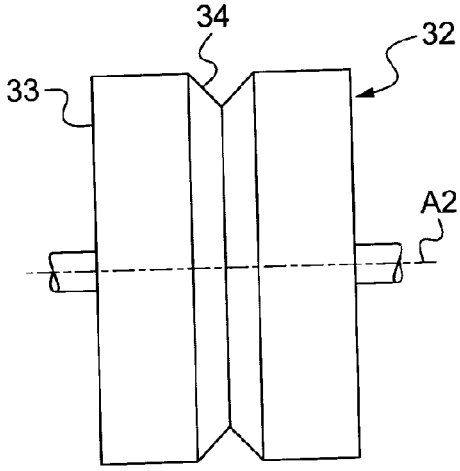
FIGS. 3 to 5 are side views of three beveling grindwheels.

As shown more particularly in FIG. 3, the machining tool 32 is, in this example, constituted by a main grindwheel 33 that is shaped, i.e. that presents a recessed machining profile of a shape that, like a negative, is complementary to the shape that is to be obtained in relief on the edge face 23 of the lens that is to be machined. More particularly, this main grindwheel 33 constitutes a body of revolution about the axis of rotation A2 and it is provided with a beveling groove 34 suitable for forming the engagement ridge 24 (FIG. 7) of complementary shape on the edge face of the lens 20. The diameter of the main grindwheel is preferably selected to be less than 25 millimeters.

This engagement ridge 24 is usually made to present, in cross-section, a profile in the form of an upside-down V-shape, which is why the engagement ridge 24 is commonly referred to as a bevel. Naturally, this engagement ridge could present some other shape in cross-section, e.g. a semicircular shape or indeed a rectangular shape.

Figure 4:
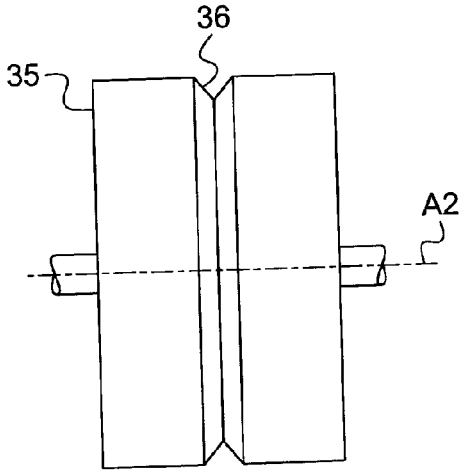

In a variant, and with reference to FIG. 4, provision may be made for the machining tool to include a set of grindwheels, including not only the above-mentioned main grindwheel 33, but also an auxiliary grindwheel 35 having a beveling groove 36 of depth and/or width that are at last 0.05 millimeters less than that depth and/or width of the beveling groove 34 of the main grindwheel 33. This small beveling groove 36 may for example present a depth and a width that are 0.3 millimeters less than the depth and the width of the beveling groove 34 of the main grindwheel 33.

Figure 5:
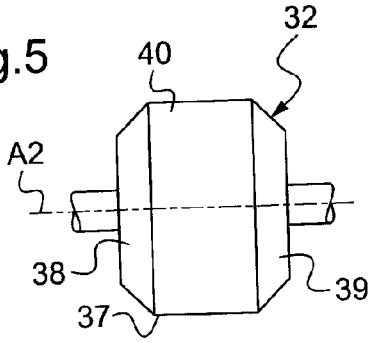

In another variant, as shown in FIG. 5, provision may be made for the machining tool 32 to include a wheel 37 presenting a central portion 40 that is circularly cylindrical about the axis of rotation A2, and on either side of its central portion 40, two end portions 38 and 39 that are circularly frustoconical about the axis of rotation A2 and that are disposed large base to large base. These two end portions 38 and 39 are then suitable for machining the two flanks of the engagement ridge 24 of the ophthalmic lens 20 in succession. Naturally, provision may also be made for these two end portions to be disposed facing each other and spaced apart from each other.

The machining tool may be of some other type. In particular, it could be formed by a milling or cutter tool mounted to rotate about the axis of rotation A2. The term "cutter tool" is used for a tool that presents, like a flat bit, a central shaft with two blades projecting radially therefrom on either side in a common plane and suitable for machining the edge face of the ophthalmic lens.

Method of Preparation

In order to implement the method of the invention, and with reference to FIG. 1, the first step is to fasten the eyeglass frame 10 selected by the future wearer in the reader appliance 1. For this purpose, the frame is inserted between the studs 4 of the jaws 3 in such a manner that each of the surrounds of the frame is ready to be felt along a path starting with the feeler 8 being inserted between the two studs 4 gripping the bottom portion of the surround that is to be felt, and then running along the bezel 11 of the surround so as to cover its entire length.

More precisely, the electronic and/or computer device 9 defines as zero the angular position and the altitude of the feeler 8 when the feeler finger 8B is placed between the two above-mentioned studs 4.

Once the eyeglass frame 10 has been fastened and the feeler 8 is in contact with the bezel 11, the electronic and/or computer device 9 causes the turntable 6 to turn so that the feeler finger 8B of the feeler 8 moves continuously along the bottom of the bezel 11.

Contact between the feeler finger 8B and the bottom of the bezel 11 is conserved by actuator means applying a radial return force on the feeler 8 that is directed towards the bezel 11. This radial return force thus serves to prevent the feeler finger 8B from rising along one or the other of the flanks of the bezel 11, and serves to prevent it from escaping from the bezel.

Consequently, the feeler 8 is controlled in angular position about the axis of rotation B and it is guided depending on its radial coordinates and its altitude, in this example, by means of the V-shape of the bezel 11.

While the turntable 6 is turning, the electronic and/or computer device 9 then reads the three-dimensional coordinates $ra_i$, $thetaa_i$, $za_i$ of a plurality of points of the acquired longitudinal profile 27 of the bezel 11, e.g. 360 points, in order to store an accurate digital image of the outline of the bezel. This image, in orthogonal projection onto the plane of the initial outline 28, is drawn as a dashed line in FIG. 6.

In a variant, provision could be made for the feeler to act discretely to feel a predefined number of points of the bezel in order to read the three-dimensional coordinates of said points.

In another variant, these three-dimensional coordinates $ra_i$, $thetaa_i$, $za_i$ could be acquired from a database registry. In this variant, the database registry includes a plurality of records, each associated with a referenced type of eyeglass frame (i.e. a given model of eyeglass frame). More precisely, each record includes an identifier that corresponds to the reference type of eyeglass frame, and a table of values e.g. specifying the three-dimensional coordinates of 360 points that are characteristic of the shape of a longitudinal profile of the bezel of an eyeglass frame of the referenced type. Thus, in order to acquire these three-dimensional coordinates $ra_i$, $thetaa_i$, $za_i$, the user may search in the database for the record of identifier that corresponds to the eyeglass frame selected by the wearer (e.g. by means of the bar code of the frame). Thereafter, the values referenced in the record are subsequently read and transmitted to the electronic and/or computer device of the shaper appliance 30. A drawback that is generally observed when using this method of acquisition is that, since two frames of the same type rarely present exactly the same shape, the three-dimensional coordinates acquired from the database may be slightly different from the real coordinates of the corresponding points of the bezel. Nevertheless, the method of the invention enables these differences to be compensated in such a manner that the lens will be easy to mount in the frame selected by the wearer.

In another variant, the coordinates of the points of the acquired longitudinal profile may be acquired in a plane, e.g. on a photograph of the wearer. In this variant, during a first operation, a digital photograph is acquired of the wearer wearing the eyeglass frame. Then, in a second operation, the shape of the inner outline of each surround of the eyeglass frame is read from the acquired photograph, e.g. by means of image processing software. The coordinates $ra_i$, $thetaa_i$ of a plurality of points of the acquired longitudinal profile are thus determined.

During a second step, a setpoint for shaping the ophthalmic lens is calculated so that it can be engaged in the surround as felt of the eyeglass frame 10.

This calculation step may be performed by calculation means of the electronic and/or computer device hosted by the outline reader appliance 1 or by those of the shaper appliance 30, or indeed by those of any other device suitable for communicating with one and/or the other of these two appliances 1, 30.

During this second step, the calculation means respond to the three-dimensional coordinates $ra_i$, $thetaa_i$, $za_i$ of the points of the longitudinal profile 27 acquired from the bezel 11 to generate radial and axial setpoints for shaping the ophthalmic lens 20. These setpoints are generated so that the lens is shaped to have a profiled engagement ridge 24 on its edge face 23 with a desired section and following the derived longitudinal profile 25 (FIG. 6) that corresponds in this example to the top of the engagement ridge 24 that is to be machined.

In this example, the derived longitudinal profile 25 is defined by 360 points of three-dimensional coordinates written $rs_j$, $thetas_j$, $zs_j$.

The derived longitudinal profile 25 is derived from the acquired longitudinal profile 27 in the sense that it is defined either to coincide therewith, or else to be spaced apart therefrom by a spacing that is practically constant. More precisely, the coordinates $rs_j$, $thetas_j$, $zs_j$ of the 360 points of the derived longitudinal profile 25 are calculated from the coordinates $ra_i$, $thetaa_i$, $za_i$ of the 360 points of the acquired longitudinal profile 27 using the following mathematical relationship:

For i =j and for j from 1 to 360

$$rs_j = ra_i + k;$$

$$thetas_j = thetaa_i;$$

$$zs_j = za_i + g(thetas_i).$$

The constant k is calculated in conventional manner as a function of the architectures of the outline reader appliance 1 and of the shaper appliance 30, and as a function of the shapes of the cross-sections of the bezel in the surround of the frame and of the beveling groove of the main grindwheel 33. This constant k serves in particular to take account of the fact that once the lens is engaged in the surround, the top of the engagement ridge (corresponding to the derived longitudinal profile 25) never comes into contact with the bottom of the bezel (corresponding to the acquired longitudinal profile 27) but is slightly offset therefrom.

The function $g(thetas_j)$ may be selected to be zero, or constant, or variable, in order to take account of a difference, if any, between the general cambers of the lens and of the bezel of the frame. This function is selected in particular so as to enable the position of the engagement ridge on the peripheral edge face 23 of the lens to be modified, e.g. in such a manner that the engagement ridge extends along the front optical face of the lens, or else rather in the middle of its edge face.

During a third step, the calculation means proceed to detect at least one singular portion Z1-Z5 of the derived longitudinal profile 25.

This detection makes it possible subsequently to machine the ophthalmic lens 20 in such a manner that its engagement ridge 24 is ideally in contact with the bezel outside the singular portions and is not in contact with the bezel in said singular portions. It can thus be understood that the engagement ridge 24 is machined in conventional and uniform manner except in the singular portions of the derived longitudinal profile 25, in such a manner that the engagement ridge 24 engages in the bezel 13 and is machined in a special and non-uniform manner in the singular portions of the derived longitudinal profile 25, such that ideally the engagement ridge 24 does not engage fully in the bezel 13 in said singular portions.

The sections of the engagement ridge 24 that are to come into contact with the bezel 13 are referred to as bearing sections, whereas the sections of the engagement ridge 24 that are not to come into contact with the bezel 13 are referred to as free sections. These free sections are named in this way since, if the lens is not properly edged and presents an outline that is too great compared with that of the corresponding surround 11, then the surround is free to deform in the free sections so as to match the shape of the engagement ridge. In this sense, the singular portions could also be referred to as free portions.

More particularly, the calculation means proceed to detect at least one singular portion P1-P5 at which the derived longitudinal profile 25 presents a radius of curvature that is at a minimum or less than a threshold, and they then derive the position of at least one singular portion Z1-Z5 of the derived longitudinal profile 25 as being a portion that is situated within less than 5 millimeters or that contains the singular point P1-P5.

To determine the positions of the singular points P1-P5, the calculation means determine the radii of curvature $Rc_j$ of the derived longitudinal profile 25 at each of its previously defined 360 points.

These radii of curvature may be calculated in various ways, in two or in three dimensions.

In this example, the radii of curvature are calculated in two dimensions in the plane of the projection of the derived longitudinal profile 25 as shown in FIG. 6, ignoring the coordinates $zs_j$ of the points of the derived longitudinal profile 25.

The radius of curvature $Rc_j$ of the derived longitudinal profile 25 at each point $P_j$ is calculated as follows:

$$Rc_j=[(rs_j\cdot\cos(\text{thetas}_j)-a_0)^2+(rs_j\cdot\sin(\text{thetas}_j)-a_1)^2]^{1/2}$$

with:

$$a_0-(b_0-b_1)/(b_2-b_3);$$

$$a_1=b_1-b_2\cdot a_0;$$

where:

$$b_0=(c_0^2-c_1^2+c_2^2-c_3^2)/(2\cdot c_2-2\cdot c_3);$$

$$b_1=(c_1^2-c_4^2+c_3^2-c_5^2)/(2\cdot c_3-2\cdot c_5);$$

$$b_2=(c_1-c_4)/(c_3-c_5);$$

$$b_3=(c_0-c_1)/(c_2-c_3);$$

and where:

$$c_0=rs_{j+1}\cdot\cos(\text{thetas}_{j+1});$$

$$c_1=rs_j\cdot\cos(\text{thetas}_j);$$

$$c_2=rs_{j+1}\cdot\sin(\text{thetas}_{j+1});$$

$$c_3=rs_j\cdot\sin(\text{thetas}_j);$$

$$c_4=rs_{j-1}\cdot\cos(\text{thetas}_{j-1});$$

$$c_5=rs_{j-1}\cdot\sin(\text{thetas}_{j-1}).$$

In a variant, in order to determine each radius of curvature, the calculation means may derive a function $f(\text{thetas}_j)$ from the coordinates of the 360 points of the derived longitudinal profile 25, which function is representative of the derived longitudinal profile 25, in polar coordinates, and capable of being differentiated twice. Each radius of curvature is then calculated using the formula:

$$Rc_j=(f'^2+f^2)^{3/2}/(2\cdot f'^2+f^2-f\cdot f'')$$

where:

$$f'=df(\text{thetas}_j)/d(\text{thetas}_j)$$

and:

$$f''=d^2f(\text{thetas}_j)/d(\text{thetas}_j)^2$$

Whatever the method used, the calculation means then proceed to determine the positions of the singular points P1-P5 of the derived longitudinal profile 25.

To do this, the calculation means compare the values of the 360 radii of curvature $Rc_j$ as calculated with a threshold value, and they select the points at which the calculated radius of curvature is less than the threshold value.

Preferably, the threshold value is predetermined and stored in the calculation means. It is then selected to be less than 20 millimeters, and in this example is equal to 10 milliseconds.

In a variant, this threshold value may be determined as a function of the values calculated for the radii of curvature $Rc_j$. In other words, the threshold value may be selected as a function of the overall shape of the derived longitudinal profile 25, or even as a function of the shape of the acquired longitudinal profile 27. As non-limiting examples, the threshold value may be selected as a function of the mean and/or the standard deviation and/or the median of the 360 calculated radii or curvature $Rc_j$. It may also be selected to be equal to the smallest calculated radius of curvature, so as to select only one point of the derived longitudinal profile 25, i.e. the point where the profile presents greatest curvature. It could equally well be selected as the Nth smallest calculated radius of curvature (N less than 360, and typically lying in the range 5 to 60), so as to enable N points of the derived longitudinal profile 25 to be selected, i.e. the N points where the curvature of the profile is the greatest.

Whatever the method used, comparing the calculated radii of curvature $Rc_j$ with the threshold value serves to identify at least one singular point of the derived longitudinal profile 25 at which the radius of curvature of the profile is less than the threshold value.

Generally, sets of a plurality of adjacent points for which the radius of curvature of the profile is less than said threshold value are thus identified. The calculation means thus define a unique singular point P1-P5 per set of points, i.e. the central point of such a set of points.

Thereafter, the calculation means define the singular portions Z1-Z5 as the zones of the derived longitudinal profile 25 that are centered on these singular points P1-P5 and that present a length lying in the range 5 millimeters to 10 millimeters, and in this example equal to 8 millimeters.

As shown in FIG. 6, the calculation means determine five singular portions that are spaced apart from one another.

Finally, during a fourth and last stage, the ophthalmic lens 20 is blocked between the shafts 31 of the shaper appliance 30 and then the ophthalmic lens 20 is edge by the shaper appliance 30.

During this step, the shafts 31 of the lens support and/or of the shaper tool 32 are controlled in such a manner that the derived longitudinal profile presents at least one singular portion Z1-Z5 having a specific departure El from the acquired longitudinal profile 27 so as to increase its radius of curvature and/or so that the section of the engagement ridge 24 is locally of reduced width and/or height over at least a singular portion Z1-Z5.

As described below, the lens is beveled in special manner in each singular portion Z1-Z5.

In a variant, provision may be made to bevel in special manner in only certain singular portions. In order to select which singular portion(s) is/are to be beveled in special manner, consideration is given to the derived longitudinal profile 25 as a whole. It presents a temple zone that corresponds to the zone of the surround of the frame where it is fastened to one of the temples of the eyeglass frame, and a nose zone that corresponds to the zone of the surround of the frame where the bridge of the eyeglass frame is fastened. Thus, if it is desired to bevel the lens in special manner in only one of the singular portions Z1-Z5, the selected singular portion Z2 is the portion closest to the zone where the temple is attached to the surround (specifically the temple zone of the derived longitudinal profile 25). If it is selected to bevel the lens in special manner in two singular portions Z1-Z5, then the selected singular portions Z2, Z3 comprise one that is the closest to the temple zone of the derived longitudinal profile 25 and another that is the closest to the nose zone of the derived longitudinal profile 25. Thus, if as a result of the temples and the bridge being fastened to the surround, the bezel is locally deformed in the temple and/or nose zones, then the two singular portions that are beveled in special manner coincide with or are situated close to those deformed temple and/or nose zones.

In a first implementation of the invention, during this shaping step, the lens support shafts 31 and/or the shaper tool 32 are controlled in such a manner that the derived longitudinal profile 26 presents, in each singular portion Z1-Z5 under consideration, a specific departure E1 from the acquired longitudinal profile 27 so as to increase its radius of curvature (see FIG. 6).

More particularly, during the shaping step, the shafts 31 and/or the shaper tool 32 are controlled in such a manner that the derived longitudinal profile 26 can be derived from the acquired longitudinal profile 27 by a mathematical relationship that, in the singular portions Z1-Z5, differs from the remainder of the derived longitudinal profile 26 in such a manner that the mean radius of curvature in each singular portion Z1-Z5 of the derived longitudinal profile 26 is greater than the mean radius of curvature that said singular portion Z1-Z5 would have had if the given mathematical relationship over said singular portion Z1-Z5 were the same as for the remainder of the derived longitudinal profile 26.

In other words, the calculation means determine a new derived longitudinal profile 26 that coincides with the initially calculated derived longitudinal profile 25 except in each of the singular portions Z1-Z5. Consequently, the above-mentioned mathematical relationship is uniform (and corresponds to the mathematical formula for deriving the derived longitudinal profile 25 as a function of the acquired longitudinal profile 27) outside the singular portions Z1-Z5, and is non-uniform in each singular portion.

To obtain the coordinates of the new derived longitudinal profile 26 in each singular portion Z1-Z5, the calculation means reduce the values of the radial coordinates $rs_j$ of the points of the initial derived longitudinal profile 25 that are situated in the singular portion Z1 under consideration.

More precisely, initially, the calculation means reduce the value of the radial coordinate $rs_j$ of each singular point P1-P5 by a value lying in the range 0.05 millimeters to 0.3 millimeters, and in this example equal to 0.1 millimeters. Then, the calculation means adjust the radial coordinates $rs_j$ of other points in the singular portions Z1-Z5 under consideration in such a manner that the new derived longitudinal profile 26 extends continuously without any angular points and without any cusps. In this way, the departure of the new derived longitudinal profile 26 from the acquired longitudinal profile 27 is constant and equal to k outside the singular portions, and is variable within each singular portion. Thus, the departure of the new derived longitudinal profile 26 from the initial derived longitudinal profile 25 is greater than 0.05 millimeters at at least one point and is always less than 0.3 millimeters.

Finally, the lens is edged in conventional manner using the new derived longitudinal profile 26 and the main grindwheel 33. In this way, the engagement ridge 24 at the end of this step presents a section that is uniform, i.e. that does not vary over its entire length.

Thus, as shown in FIG. 7, at the end of edging, the top of the engagement ridge in each singular portion Z1-Z5 under consideration presents a profile 24A that is at a distance from the blocking axis A1 that is less than the distance it would have had if the lens had been beveled using the initial longitudinal profile 25 (profile 24B). In this way, when the feeling of the surround of the frame and/or the edging of the lens are performed in a manner that is not perfect, and as a result the outline of the lens is slightly too great relative to the outline of the surround, the special beveling allows the lens to continue to be capable of being mounted in the surround without such mounting giving rise to mechanical stresses that are harmful to the lifetime of the ophthalmic lens 20.

Advantageously, after it has been determined, provision may be made to store the shape of the new derived longitudinal profile 26 in a database registry. For this purpose, the registry may include a plurality of records, each of which is associated with a referenced type or a referenced model of eyeglass frame and contains the shape of the new derived longitudinal profile 26 that is common to the frames of this type or this model. The shape of the new derived longitudinal profile 26 is then stored in the registry by searching the registry for a record that corresponds to the frame in question and by writing the shape of the new derived longitudinal profile 26 in said record.

In this way, during subsequent edging of an ophthalmic lens for mounting in a frame of the same type or of the same model, the calculation means may acquire from the registry the shape of the new derived longitudinal profile 26 so as to be able to machine the lens directly with said profile.

In a second implementation of the invention, during the shaping step, the lens support shafts 31 and/or the shaper tool 32 are controlled to follow the initial derived longitudinal profile 25 in such a manner as to make an engagement ridge 24 that is profiled, i.e. of uniform section, except in each singular portion Z1-Z5 where they are controlled so as to reduce only the size of the section of the engagement ridge 24.

This implementation presents a particular advantage. As can be seen in FIG. 8, the fact of merely reducing the size of the section of the engagement ridge without changing the setpoint radius for edging the lens (i.e. without locally modifying the derived longitudinal profile 25 within the singular portions) makes it possible to ensure that the position of the flat beside the engagement ridge (i.e. the flat portion of the edge face of the lens beside the engagement ridge) remains locally unchanged. After the lens has been mounted in its surround, the flat of the engagement ridge 24 then extends close to the inside face of the surround of the eyeglass frame, as over the remainder of the outline of the lens, without giving rise to an unsightly gap between the edge face of the lens and the frame in the singular portions.

Preferably, edging the lens includes an initial stage of machining the engagement ridge 24 with a uniform section following the derived longitudinal profile 25 and a second stage of paring away the engagement ridge 24 over each singular portion Z1-Z5 of the derived longitudinal profile 25.

In this example, the first machining stage is performed using the shaped main grindwheel 33 (shown in FIG. 3), while the second stage is performed using the auxiliary grindwheel 35 (shown in FIG. 4).

For this purpose, the beveling groove 36 of the auxiliary beveling grindwheel 35 is brought into contact with the engagement ridge 24 of the ophthalmic lens 20 at one of the ends of a first singular portion. Thereafter the lens support shafts 31 and/or the shaping tool 32 are controlled so that the engagement ridge 24 of the lens is pared away over the entire length of the singular portion, and then over the entire length of each of the other singular portions. As shown in FIG. 8, this control ensures that the profile of the engagement ridge 24 at each singular point P1-P5 presents a height and/or a depth that are at least 0.05 millimeters and at most 0.3 millimeters less than the height and/or the width of the engagement ridge 24 outside the singular portions. This control is also arranged so that the engagement ridge 24 does not present any discontinuity, in particular at the ends of each of the singular portions Z1-Z5.

It can also be observed that if the section of the engagement ridge 24 is reduced in height, then the derived longitudinal profile 25 along which said engagement ridge 24 extends is slightly deformed in said singular portions.

In a variant, the engagement ridge 24 may be pared away in a different manner. For example, it may be performed using the main grindwheel 33 during a second pass, by moving the grindwheel in a direction that is substantially parallel to the blocking axis A1, at a transverse offset relative to the derived longitudinal profile 25. For this purpose, during the second pass, the lens support shafts 31 and/or the shaper tool 32 are controlled in each singular portion Z1-Z5 under consideration in such a manner as to be offset progressively axially (along the blocking axis A1) relative to the position they occupied during the first pass. Thus, during the second pass, one of the flanks of the engagement ridge 24 is machined by one of the flanks of the beveling groove 34 of the main grindwheel 33, thus having the effect of reducing both the height and the width of the engagement ridge 24 in each singular portion under consideration.

In a variant, the engagement ridge 24 may be pared away with the help of a cylindrical portion of the main grindwheel 33, by planning the top of the engagement ridge 24 so as to flatten its top edge, and possibly even in such a manner as to completely eliminate the engagement ridge 24 locally. In this variant, only the height of the engagement ridge is modified.

In another variant, the engagement ridge 24 may be made and also pared away simultaneously.

Thus, during beveling of the lens by the main grindwheel 33, the lens support shafts 31 and/or the shaper tool 32 may be controlled so as to present reciprocating movements in an axial direction (along the blocking axis A1). Thus, these reciprocating movements enable both flanks of the engagement ridge to be planed.

In order to shape the lens in such a manner that the reduction of the engagement ridge 24 is performed simultaneously with said engagement ridge being formed, it is also possible to use the wheel shown in FIG. 5, with the engagement ridge 24 being machined in two successive stages, namely a stage of machining a first one of its flanks and a stage of machining a second one of its flanks.

For this purpose, initially, the electronic and/or computer device of the shaper appliance 30 controls the radial movement of the wheel relative to the shafts 31 in coordinated manner so as to position a first portion of the conical end 39 of the wheel 37 against the edge face of the lens, beside its front face. Thereafter, the wheel 37 and the lens support shafts 31 are controlled as to from the front flank of the engagement ridge 24. Here, control is arranged so that the front flank of the engagement ridge 24 is formed at a constant distance from the front face of the lens, except in the singular portions, where the front flank is further away from the front face.

Thereafter, the electronic and/or computer device of the shaper appliance 30 controls the radial movements of the wheel relative to the shafts 31 in coordinated manner to position a second conical end portion 38 of the wheel 37 against the edge face of the lens, beside its rear face. Thereafter, the wheel 37 and the lens support shafts 31 are controlled to form the rear flank of the engagement ridge 24. Here the control is arranged to ensure that the rear flank of the engagement ridge 24 is formed at a constant distance from the front face of the lens, except in the singular portions, where it is closer to the front face.

In this way, the ophthalmic lens is beveled so that its engagement ridge 24 presents a local reduction in height and/or width in each of the singular portions Z1-Z5.

In another variant, the electronic and/or computer device of the shaper appliance 30 may control the radial movements of the shaper tool and/or of the shafts 31 in such a manner as not only to reduce the width and/or the height of the section of the engagement ridge 24 in each singular portion, but also as to machine the flats beside the engagement ridge 24 (by determining the shape of a new longitudinal profile from the derived longitudinal profile, using a method of the same type as that described above).

Advantageously, the shape of the derived longitudinal profile 25 may be recorded in a record of the database registry, together with the positions of the singular portions on the profile.

More precisely, after determining the three-dimensional coordinates of the derived longitudinal profile 25 and the positions of the singular portions and/or the singular points, the electronic and/or computer device of the shaper appliance 30 may transmit said data to the registry so that it stores it in a record having its identifier corresponding to the eyeglass frame selected by the wearer, or else in a new record provided specifically therefor. This record can then be read subsequently in order to edge another lens that is to be mounted in a frame of the same type.

Furthermore, after said first ophthalmic lens has been edged, it is possible to edge a second ophthalmic lens in order to mount it in a second surround of said eyeglass frame 10, by forming a genuinely profiled engagement ridge on its edge face. This ridge may then be made in such a manner as to follow a longitudinal profile that is symmetrical to the derived longitudinal profile 25 such that each of its sections presents a shape that is identical to the shape of the corresponding section (in symmetry) of the engagement ridge 24 of the first lens.

By means of the invention, if the two surrounds of the eyeglass frame 10 are not perfectly symmetrical even though both lenses are machined in symmetrical manner, the lenses continue to be mountable in their respective surrounds.

The invention finds a particularly advantageous application in methods of preparing lenses that are implemented by the clients (opticians) of contractors, i.e. clients who subcontract the fabrication and edging of lenses.

More precisely, under such circumstances, it is possible to take into consideration firstly a client terminal installed on the premises of a client for ordering lenses, and a manufacturer terminal installed on the premises of a lens manufacturer for fabricating and edging lenses.

The client terminal includes computer means for recording and transmitting order data for the ophthalmic lens 20, e.g. via an Internet protocol (IP) type communications protocol. The order data includes eyesight correcting prescription data (e.g. data concerning optical power, centering, . . . ), and data relating to the frame.

The manufacturer terminal has computer means for receiving and recording the order data transmitted by the client terminal. It also includes a device for fabricating an ophthalmic lens to comply with the prescription data, e.g. provided with means for molding the lens and/or for machining at least one of the optical faces thereof. It also includes a device for shaping the ophthalmic lens in compliance with the data relating to the frame. The shaper device is designed in particular to implement the above-described blocking and edging steps, in one or other of the variant implementations described.

In order to implement the method of preparing a lens in accordance with the invention, the step of acquiring the acquired longitudinal profile 27 comprises three successive operations.

During a "determination" first operation, the client determines a reference for the eyeglass frame 10.

During an "ordering" second operation, the client terminal transmits the order data for a lens (including said reference) and the manufacturer terminal receives the data.

The third operation is performed using a database registry forming part of the manufacturer terminal, in which each record is associated with a particular type of eyeglass frame 10 and contains firstly a reference for the eyeglass type, and secondly the shape of an acquired longitudinal profile that is common to all frames of the type. During this "searching" third operation, the manufacturer uses the reference acquired during the first operation to search the registry for the shape of the longitudinal profile of the bezel of the corresponding frame. In this way, the manufacturer can subsequently implement the above-described method, in particular by determining the positions of the singular portions of the acquired longitudinal profile.

In this way, the manufacturer can make use of the three-dimensional coordinates in order to edge the ophthalmic lens to the desired shape, without having the frame in which the lens is to be engaged physically present. Furthermore, the method of the invention makes it possible to compensate for any errors concerning the acquisition of the shape of the longitudinal profile and/or concerning the machining of the lens, so that the lens will be easily mountable at the first attempt in the frame selected by the wearer. This advantage is of major importance in this context since it avoids any need for the lens to be returned to the manufacturer in order to be reworked, where any such return is always expensive and time consuming.

In a variant, provision could be made for the step of acquiring the acquired longitudinal profile 27 to include a step of the client determining the shape of a longitudinal profile of the bezel 11, i.e. the shape of the acquired longitudinal profile 27, and an ordering step of transmitting and receiving order data including the shape of the acquired longitudinal profile 27. In this variant, the positions of the singular portions on the acquired longitudinal profile 27 may be determined equally well by the manufacturer or by the client.

Figure 9:
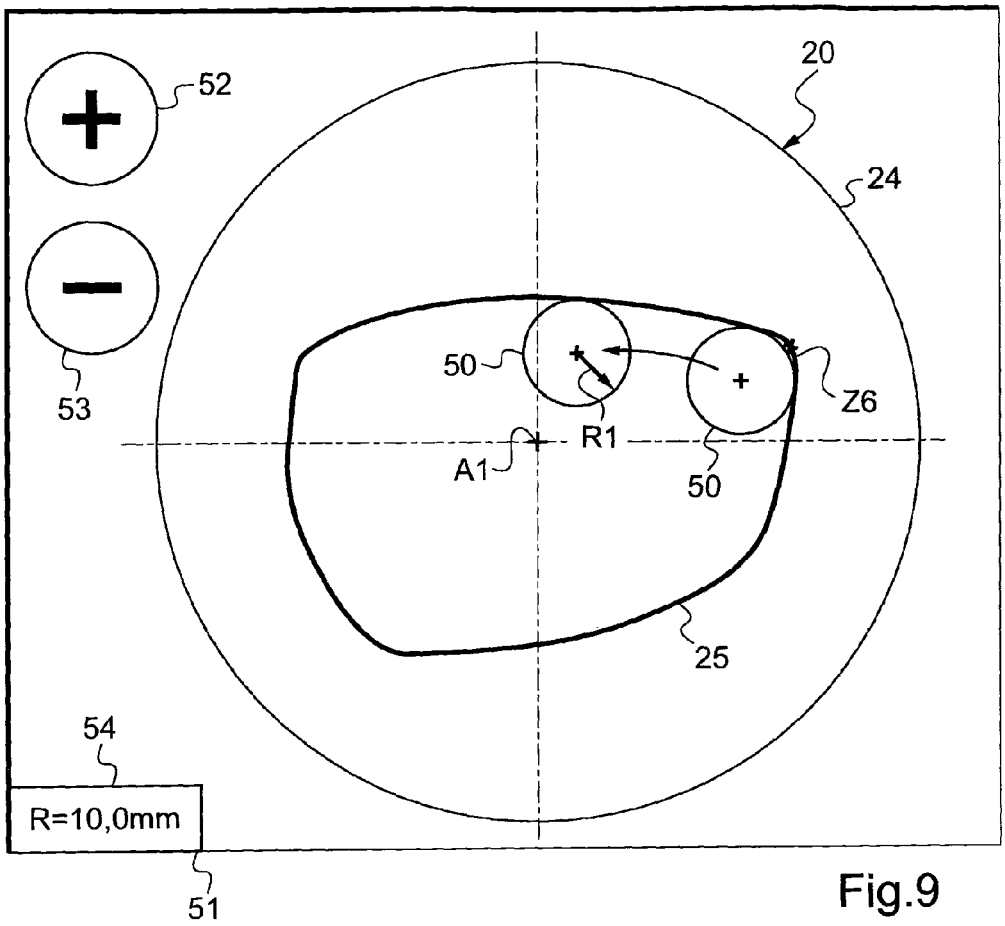
FIG. 9 is a view of an image of a non-edge ophthalmic lens having superposed thereon images of the final outline and of a cursor.

In another implementation of the invention, shown in FIG. 9, each singular portion Z6 of the derived longitudinal profile 25 is derived manually by the operator.

For this purpose, a man/machine interface including in particular a screen 51, is made available to the operator. The screen 51 is preferably touch-sensitive and is accompanied by a stylus enabling the operator to interact accurately with the screen 51. The interface is also fitted with an electronic device suitable firstly for communicating with the electronic and/or computer device of the outline reader appliance 1 or with that of the shaper appliance 30, and secondly for displaying images on the screen.

In particular, the electronic device is adapted to display on the screen 51 an image of the outline 24 of the non-edged ophthalmic lens 20, an image representing two buttons 52 and 53 given respective signs "+" and "−", an image of a cursor 50 in the form of a circle, and an image 54 of a numerical value that corresponds to the radius R1 of the cursor 50. It is also adapted to display an image of the derived longitudinal profile 25.

In order to determine the positions of the singular portions Z6 of the derived longitudinal profile 25, once the three-dimensional coordinates of the 360 points of the derived longitudinal profile 25 have been calculated, these coordinates are transmitted to the electronic device of the screen 51 which then determines, as a function of the coordinates, the shape of the derived longitudinal profile 25, which shape is then displayed on the touch-sensitive screen 51.

Thereafter, the operator adjusts the radius R1 of the cursor 50 by pressing on one or other of the two buttons 52 and 53 with the stylus. The choice of value for the radius R1 enables the operator to set a radius of curvature threshold.

The initial value of the radius R1 of the cursor 50 is initially set at 10 millimeters and it may thus be modified over a range of values extending from 5 millimeters to 20 millimeters.

Once the radius R1 has been adjusted, the operator uses the stylus to move the cursor 50, as shown in FIG. 9, so that the circular edge of the cursor runs along the derived longitudinal profile 25. The electronic device of the screen 51 is adapted in this example to assist the operator by guiding the cursor so as to maintain point contact between the circular edge of the cursor 50 and the derived longitudinal profile 25.

When the operator is of the opinion that the shapes of the cursor 50 and of the derived longitudinal profile match, then the operator selects a portion of the derived longitudinal profile 25 in which the cursor is located, e.g. by "double-clicking" with the stylus on the touch-sensitive screen 51.

Shapes are considered in this example to "match" when the cursor presents two points of contact with the derived longitudinal profile 25. The portions of the derived longitudinal profile 25 in which the cursor has two points of contact present a radius of curvature that is less than the radius of the cursor, i.e. less than the threshold as determined by the operator. These portions thus correspond to the singular portions Z6 of the derived longitudinal profile 25. These singular portions Z6 are then defined as being the portions that are situated between the two points of contact between the cursor 50 and the derived longitudinal profile 25.

Preferably, the selected portions are then displayed in color so that the operator can confirm the selection visually.

The three-dimensional coordinates of the points belonging to the singular portions Z6 are then transmitted to the shaper appliance 30 so that it shapes the lens in the special manner in said singular portions.

Figure 10:
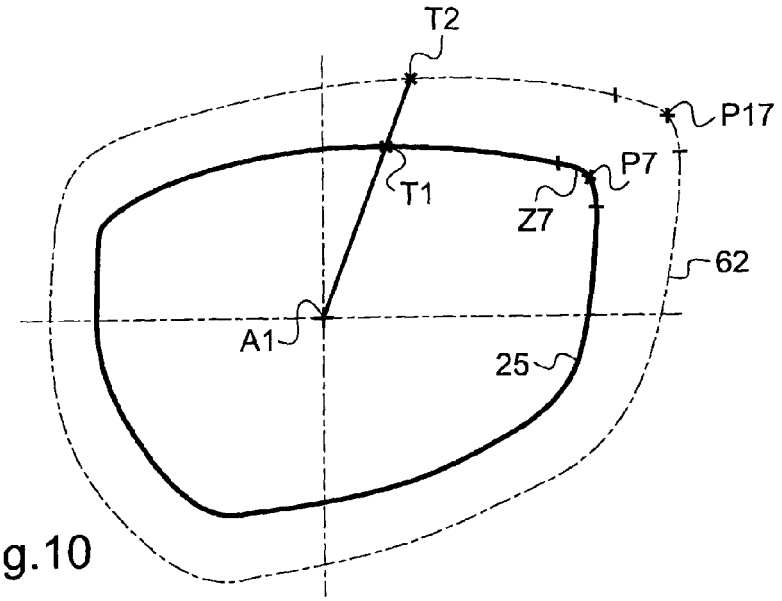
FIG. 10 is a view of the final outline of an ophthalmic lens after edging and of a shape that is derived from the final outline by proportional transformation.
Figure 12:
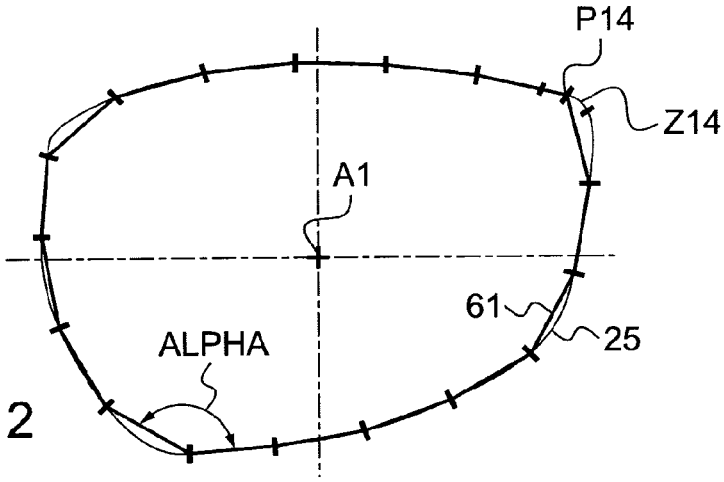
FIG. 12 is a view of the final outline of an ophthalmic lens after edging and of a polygonal shape derived from the final outline.

In other variant implementations of the invention as shown in FIGS. 10 to 12, each singular portion of the derived longitudinal profile 25 is determined by considering not the shape of the derived longitudinal profile 25 or of the acquired longitudinal profile 27, but rather the shape of a third longitudinal profile 60; 61; 62 that is derived from one or other of said two longitudinal profiles 25, 27 using a given derivation rule, and that is distinct from said two longitudinal profiles.

More particularly, after determining the third longitudinal profile, the calculation means establish an association between each point of the third longitudinal profile 60; 61; 62 and each point of the derived longitudinal profile 25 using a given correspondence rule, and then they determine the positions of the singular portions of the derived longitudinal profile 25 as those portions that are situated at less than 5 millimeters from or that contain a singular point of associated points on said third longitudinal profile 60; 61; 62 that is an angular point or that presents a radius of curvature that is at a minimum or below a threshold.

In the variant implementation of the method of the invention shown in FIG. 10, each singular portion of the derived longitudinal profile 25 is determined on a third longitudinal profile 62 that is derived from the profile 25 by a proportional transformation calculation.

More precisely, after determining the three-dimensional coordinates of the 360 points of the derived longitudinal profile 25, the calculation means derive from these coordinates the coordinates of 360 points of the third longitudinal profile 62.

For this purpose, given the coordinates $rs_j$, $thetas_j$, $zs_j$ of a point $T_j$1 of the derived longitudinal profile 25 and the coordinates $rh_j$, $thetas_j$, $zs_j$ of a corresponding $T_j$2 of the third longitudinal profile 62, the coordinates $rh_j$, $thetah_j$, $zh_j$ of the 360 points of this third longitudinal profile are calculated using the following formulae:

For j going from 1 to 360, $$rh_j = rs_j \cdot \exp(-0.5(rs_j - \text{rmin})/(\text{rmax} - \text{rmin}));$$

$$\text{thetah}_j = \text{thetas}_j;$$

$$zh_j = zs_j$$

In this formula, the constant rmax corresponds to the coordinate $rs_j$ of the point of the derived longitudinal profile 25 that is furthest from the blocking axis A1 and the constant rmin corresponds to the coordinate $rs_j$ of the point of the derived longitudinal profile 25 that is closest to the blocking axis A1.

Naturally, the coordinates $rh_j$ of the points of the third longitudinal profile 62 may be calculated in some other way, e.g. by means of the following formula:

$$rh_j = rs_j + v$$

where v is an arbitrary constant.

In any event, once the coordinates have been calculated, the calculation means determine the radii of curvature of the third longitudinal profile 62 at its 360 points.

Then, during a comparison step, the calculation means compare these radii of curvature with a predetermined threshold in order to situate at least one point P17 of small radius of curvature on the third longitudinal profile 62.

Finally, the calculation means derive from the coordinates of this point P17 the coordinates of the corresponding singular portion P7 that is situated on the derived longitudinal profile 25. As explained above, the calculation means then determine the position of at least one singular portion Z7 of the derived longitudinal profile 25 that is centered on said singular portion P7.

In the variant implementation of the method of the invention shown in FIG. 11, each singular portion of the derived longitudinal profile 25 is determined by means of a third longitudinal profile that is circumscribed around the derived longitudinal profile 25. In this example, this third longitudinal profile corresponds to the boxing frame 60.

More precisely, after acquiring the three-dimensional coordinates $rs_j$, $\text{thetas}_j$, $zs_j$ of the 360 points of the derived longitudinal profile 25, the calculation means of the device derive the shape of the boxing frame 60 from these coordinates.

The calculation means then establish a correspondence rule between the points of the boxing frame 60 and the points of the derived longitudinal profile 25. For this purpose, a point of the derived longitudinal profile 25 is defined as being associated with a point of the boxing frame 60 if both points have the same angular position about the blocking axis A1, i.e. if both points are situated on the same straight line passing through the blocking axis A1.

Thereafter, the calculation means determine the coordinates of four angular points P20, P21, P22, and P23 of the boxing frame 60, i.e. in this example, the coordinates of the four corners of the frame.

The calculation means derive therefrom the coordinates of four associated singular points P10, P11, P12, P13. In FIG. 11, these four singular points P10, P11, P12, P13 correspond to the points of intersection between the diagonals of the boxing frame 60 and the derived longitudinal profile 25. These four singular points P10, P11, P12, P13 are situated close to the highly curved zones of the derived longitudinal profile 25.

Consequently, the calculation means can derive the positions of four curved singular portions Z10, Z11, Z12, and Z13 of the derived longitudinal profile 25 from the coordinates of these four singular points.

In the variant implementation of the method of the invention shown in FIG. 12, each singular portion of the derived longitudinal profile 25 is determined by means of a third profile that is in the form of a polygon that is inscribed within the derived longitudinal profile 25.

This polygon is selected to have at least ten sides of equal length with their ends lying on the derived longitudinal profile 25.

Naturally, in a variant, this polygon could be selected as being circumscribed around the derived longitudinal profile 25, in such a manner that each of its sides is tangential to the derived longitudinal profile 25.

Either way, the calculation means then establish a correspondence rule between the points of the polygon 61 and the points of the derived longitudinal profile 25. For this purpose, a point of the derived longitudinal profile 25 is defined as being associated with a point of the polygon 61 if both points are at the same angular position about the blocking axis A1, i.e. if both points are situated on the same line passing through the blocking axis A1.

Thereafter, during a calculation step, the calculation means determine the angles ALPHA at each junction between sides of the polygon.

During a comparison step, the calculation means compare these angles with a predetermined threshold that preferably lies in the range 150 degrees to 175 degrees. They deduce therefrom the position of at least one junction point P14 between two sides of the polygon that is particularly sharp. This junction point P14, here forming part of the derived longitudinal profile 25, is then situated close to a highly curved portion of said profile.

Consequently, the calculation means can then deduce from the coordinates of this junction point P14 the position of a curved singular portion Z14 of the derived longitudinal profile 25.

Figure 13:
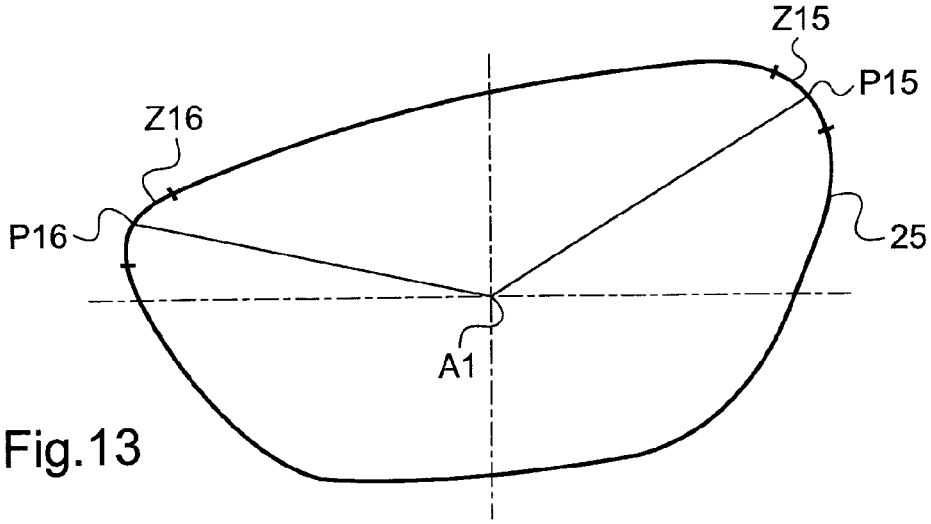
FIG. 13 is a view of the final outline of an ophthalmic lens after shaping.

In another variant implementation of the invention shown in FIG. 13, each singular portion of the derived longitudinal profile 25 may be determined by selecting the singular portions Z15, Z16 of the derived longitudinal profile 25 that are situated at less than 5 millimeters from or that contain a singular point P15, P16 at a distance from the blocking axis A1 that is at a maximum or that is greater than a threshold.

More particularly, in this example, the calculation means select amongst the 90 points of the top-left quadrant of the derived longitudinal profile 25 (points having indices j running from 91 to 180) and from the 90 points of the top-right quadrant of said derived longitudinal profile 25 (points of indices j going from 181 to 270), the point in each quadrant that is furthest from the blocking axis A1 (i.e. the point of each quadrant that presents a maximum radial coordinate). These two points are then situated close to highly curved portions of the derived longitudinal profile 25.

The calculation means then derive therefrom the positions of two singular portions Z15, Z16 of the derived longitudinal profile 25, which portions are defined as being the portions of the profile that have a length of 10 millimeters and that are centered on the two points P15 and P16.

The invention claimed is:

1. A method of preparing an ophthalmic lens (20) for mounting in a surround of an eyeglass frame (10), the method comprising:

an acquisition step of acquiring a first longitudinal profile (27) of said surround;

a blocking step of blocking the ophthalmic lens (20) in support means (31); and an edging step of edging the ophthalmic lens (20) by shaper means (32), during which the support means (31) or the shaper means (32) are controlled in such a manner that the ophthalmic lens (20) is edged to have an engagement ridge (24) on its edge face (23) that is generally profiled with a desired section and that extends along a second longitudinal profile (25) that is derived from the first longitudinal profile (27);

wherein the method includes a determination step of determining at least one singular portion (Z1-Z5) of the second longitudinal profile (25) as a portion that is situated at less than 5 millimeters from or that contains a singular point (P1-P5) at which the second longitudinal profile (25) presents a radius of curvature that is at a minimum or less than a threshold; and in that during the edging step, the support means (31) or the shaper means (32) are controlled in such a manner that the section of the engagement ridge (24) is reduced in width or height over said singular portion (Z1-Z5).

2. The method according to claim 1, wherein said determination step excludes searching for said singular portion (Z1-Z5) of the second longitudinal profile (25) as a portion that presents a singular point (P1-P5) that is a geometrical singularity, i.e. an angular point or a cusp.

3. A method of preparing an ophthalmic lens (20) for mounting in a surround of an eyeglass frame (10), the method comprising:

an acquisition step of acquiring a first longitudinal profile (27) of said surround;

a blocking step of blocking the ophthalmic lens (20) in support means (31); and an edging step of edging the ophthalmic lens (20) by shaper means (32), during which the support means (31) or the shaper means (32) are controlled in such a manner that the ophthalmic lens (20) is edged to have an engagement ridge (24) on its edge face (23) that is generally profiled with a desired section and that extends along a second longitudinal profile (25) that is derived from the first longitudinal profile (27);

wherein the method includes a determination step of determining at least one singular portion (Z1-Z5) of the second longitudinal profile (25) as a portion that is situated at less than 5 millimeters from or that contains a singular point (P1-P5) whose distance from an axis of the ophthalmic lens (20) passing inside the second longitudinal profile (25) is at a maximum or greater than a threshold; and in that during the edging step, the support means (31) or the shaper means (32) are controlled in such a manner that the section of the engagement ridge (24) is reduced in width or height over said singular portion (Z1-Z5).

4. A method of preparing an ophthalmic lens (20) for mounting in a surround of an eyeglass frame (10), the method comprising:

an acquisition step of acquiring a first longitudinal profile (27) of said surround;

a blocking step of blocking the ophthalmic lens (20) in support means (31); and an edging step of edging the ophthalmic lens (20) by shaper means (32), during which the support means (31) or the shaper means (32) are controlled in such a manner that the ophthalmic lens (20) is edged to have an engagement ridge (24) on its edge face (23) that is generally profiled with a desired section and that extends along a second longitudinal profile (25) that is derived from the first longitudinal profile (27);

wherein the method takes into consideration a third profile (60; 61; 62) derived from the first or the second longitudinal profile (25, 27) in application of a given derivation rule, the third profile being distinct from said first and second longitudinal profiles (25, 27) and each point thereof being associated with a point of the second longitudinal profile (25) in application of a given correspondence rule, and it includes a determination step of determining at least one singular portion (Z1-Z5) of the second longitudinal profile (25) as a portion that is situated at less than 5 millimeters from or that contains a singular point (P1-P5) for which the associated point on said third longitudinal profile (60; 61; 62) is angular or presents a radius of curvature that is at a minimum or that is less than a threshold; and in that during the edging step, the support means (31) or the shaper means (32) are controlled in such a manner that the section of the engagement ridge (24) is reduced in width or height over said singular portion (Z1-Z5).

5. The method according to claim 1, wherein the width or the height of the section of the engagement ridge (24) are, at at least one point of each singular portion, reduced by at least 0.05 millimeters.

6. The method according to claim 5, wherein the width and the height of the section of the engagement ridge (24) are, at each point in each singular portion, reduced by at most 0.3 millimeters.

7. A method of preparing an ophthalmic lens (20) for mounting in a surround of an eyeglass frame (10), the method comprising:

an acquisition step of acquiring a first longitudinal profile (27) of said surround;

a blocking step of blocking the ophthalmic lens (20) in support means (31); and an edging step of edging the ophthalmic lens (20) by shaper means (32), during which the support means (31) or the shaper means (32) are controlled in such a manner that the ophthalmic lens (20) is edged to have an engagement ridge (24) on its edge face (23) that is generally profiled with a desired section and that extends along a second longitudinal profile (26) that is derived from the first longitudinal profile (27);

wherein the method includes a determination step of determining at least one singular portion (Z1-Z5) of the second longitudinal profile (26) as a portion that is situated at less than 5 millimeters from or that contains a singular point (P1-P5) at which the second longitudinal profile (26) presents a radius of curvature that is at a minimum or less than a threshold; and in that during the edging step, the support means (31) or the shaper means (32) are controlled in such a manner that the second longitudinal profile (26) is derivable from the first longitudinal profile (27) by a mathematical relationship that, over said singular portion (Z1-Z5), differs from the remainder of the second longitudinal profile (26) in such a manner that the mean radius of curvature of said singular portion (Z1-Z5) of the second longitudinal profile (26) is increased relative to the mean radius of curvature that said singular portion (Z1-Z5) would have presented if the given mathematical relationship had been the same over said singular portion (Z1-Z5) as for the remainder of the second longitudinal profile (26).

8. The method according to claim 7, wherein said determination step excludes searching for said singular portion (Z1-Z5) of the second longitudinal profile (26) as a portion that presents a singular point (P1-P5) that is a geometrical singularity, i.e. an angular point or a cusp.

9. A method of preparing an ophthalmic lens (20) for mounting in a surround of an eyeglass frame (10), the method comprising:

an acquisition step of acquiring a first longitudinal profile (27) of said surround;

a blocking step of blocking the ophthalmic lens (20) in support means (31); and an edging step of edging the ophthalmic lens (20) by shaper means (32), during which the support means (31) or the shaper means (32) are controlled in such a manner that the ophthalmic lens (20) is edged to have an engagement ridge (24) on its edge face (23) that is generally profiled with a desired section and that extends along a second longitudinal profile (26) that is derived from the first longitudinal profile (27);

wherein the method includes a determination step of determining at least one singular portion (Z1-Z5) of the second longitudinal profile (26) as a portion that is situated at less than 5 millimeters from or that contains a singular point (P1-P5) whose distance from an axis of the ophthalmic lens (20) passing inside the second longitudinal profile (26) is at a maximum or greater than a threshold; and in that during the edging step, the support means (31) or the shaper means (32) are controlled in such a manner that the second longitudinal profile (26) is derivable from the first longitudinal profile (27) by a mathematical relationship that, over said singular portion (Z1-Z5), differs from the remainder of the second longitudinal profile (26) in such a manner that the mean radius of curvature of said singular portion (Z1-Z5) of the second longitudinal profile (26) is increased relative to the mean radius of curvature that said singular portion (Z1-Z5) would have presented if the given mathematical relationship had been the same over said singular portion (Z1-Z5) as for the remainder of the second longitudinal profile (26).

10. A method of preparing an ophthalmic lens (20) for mounting in a surround of an eyeglass frame (10), the method comprising:

an acquisition step of acquiring a first longitudinal profile (27) of said surround;

a blocking step of blocking the ophthalmic lens (20) in support means (31); and an edging step of edging the ophthalmic lens (20) by shaper means (32), during which the support means (31) or the shaper means (32) are controlled in such a manner that the ophthalmic lens (20) is edged to have an engagement ridge (24) on its edge face (23) that is generally profiled with a desired section and that extends along a second longitudinal profile (26) that is derived from the first longitudinal profile (27);

wherein the method takes into consideration a third profile (60; 61; 62) derived from the first or the second longitudinal profile (26, 27) in application of a given derivation rule, the third profile being distinct from said first and second longitudinal profiles (26, 27) and each point thereof being associated with a point of the second longitudinal profile (26) in application of a given correspondence rule, and it includes a determination step of determining at least one singular portion (Z1-Z5) of the second longitudinal profile (26) as a portion that is situated at less than 5 millimeters from or that contains a singular point (P1-P5) for which the associated point on said third longitudinal profile (60; 61; 62) is angular or presents a radius of curvature that is at a minimum or that is less than a threshold; and in that during the edging step, the support means (31) or the shaper means (32) are controlled in such a manner that the second longitudinal profile (26) is derivable from the first longitudinal profile (27) by a mathematical relationship that, over said singular portion (Z1-Z5), differs from the remainder of the second longitudinal profile (26) in such a manner that the mean radius of curvature of said singular portion (Z1-Z5) of the second longitudinal profile (26) is increased relative to the mean radius of curvature that said singular portion (Z1-Z5) would have presented if the given mathematical relationship had been the same over said singular portion (Z1-Z5) as for the remainder of the second longitudinal profile (26).

11. The method according to claim 7, wherein the singular portion (Z1-Z5) of the second longitudinal profile (26) presents, relative to the shape that said portion would have presented if the mathematical relationship had been the same over the singular portion (Z1-Z5) as for the remainder of said second longitudinal profile (26), a departure at at least one point that is greater than 0.05 millimeters.

12. The method according to claim 11, wherein the singular portion (Z1-Z5) of the second longitudinal profile (26) presents, relative to the shape that said portion would have presented if the mathematical relationship had been the same over the singular portion (Z1-Z5) as for the remainder of said second longitudinal profile (26), a departure that is less than 0.3 millimeters.

13. The method according to claim 7, wherein the shaper means (32) or the support means (31) are controlled in such a manner that at the end of the edging step, the engagement ridge (24) presents a section of uniform shape along the second longitudinal profile (26).

14. The method according to claim 4, wherein said third longitudinal profile is a polygon that is circumscribed (60) or inscribed (61) relative to the first or second longitudinal profile (25; 26, 27).

15. The method according to claim 4, wherein said third longitudinal profile is a proportional transformation (62) of the first or the second longitudinal profile (25; 26, 27).

16. The method according to claim 1, wherein said threshold is less than 20 millimeters, and is preferably equal to 10 millimeters.

17. The method according to claim 1, wherein said threshold is a function of the shape of the first or the second longitudinal profile (25; 26, 27).

18. The method according to claim 1, wherein, during the determination step of determining each singular portion (Z6) of the second longitudinal profile (25; 26), an image of the second longitudinal profile (25; 26) is displayed together with an image of a cursor (50) having at least one dimension that is a function of said threshold, and at least one singular portion (Z6) is selected manually in which the shape of the cursor and the shape of the second longitudinal profile (25; 26) match.

19. The method according to claim 1, including, after the determination step, a step of searching in a database registry in which each record is associated with a reference type of eyeglass frame (10) and contains the shape of the second longitudinal profile (25; 26), for a record corresponding to the frame in question, and a step of writing the positions of each of the singular portions (Z1-Z5) on the second longitudinal profile (25; 26) into said record.

20. The method according to claim 1, wherein, for the second longitudinal profile (25; 26) including at least two singular portions (Z1-Z5) including a first singular portion (Z2) that is the closest to a temple portion of the second longitudinal profile (25; 26), the support means (31) or the shaper means (32) are controlled in such a manner that the section of the engagement ridge (24) is reduced locally in width or in height at least in the first singular portion (Z2) or in such a manner that the second longitudinal profile (26) is derived by said mathematical relationship that is different at least in the first singular portion (Z2).

21. The method according to claim 1, wherein each singular portion (Z1-Z5) of the second longitudinal profile (25; 26) is centered on said singular point (P1-P5) and presents a length of less than 10 millimeters.

22. The method according to claim 1, wherein during the edging step, the support means (31) or the edging means (32) are controlled in such a manner that each longitudinal profile of the engagement ridge (24) extends continuously along the edge face (23) of the ophthalmic lens (20), without any point that is an angular point or a cusp.

23. The method according to claim 1, wherein during the acquisition step, a record is read in a database registry in which each record is associated with a reference type of eyeglass frame (10) and contains the shape of the first longitudinal profile (27) corresponding to the reference type of eyeglass frame.

24. The method according to claim 23, wherein, during the determination step, said record is read that contains not only the shape of the first longitudinal profile (27), but also the shape of said second longitudinal profile (25; 26) and the positions of said singular portions (Z1-Z5).

25. The method according to claim 1, including steps of blocking and edging a second ophthalmic lens in order to enable it to be mounted in a second surround of said eyeglass frame (10), by forming an engagement ridge on its edge face that is generally profiled and that extends with a given longitudinal profile that is symmetrical to said second longitudinal profile (25; 26), and in which each section presents a width or a height equal to the width or the height of the symmetrical section of the engagement ridge (24) of the edged first ophthalmic lens (20).

26. The method according to claim 1, implemented by means of a system comprising firstly a client terminal installed beside a client and including computer means for recording and transmitting order data concerning the ophthalmic lens (20), said order data including data relating to the frame, and secondly a manufacturer terminal installed beside a manufacturer and including computer means for receiving and recording the order data transmitted by the client terminal, and a shaper device for edging said fabricated ophthalmic lens, the device being designed to implement said blocking and edging step, said acquisition step comprising:

a determination step of the client determining the first longitudinal profile (27) of the surround of the eyeglass frame (10); and an ordering step of the client terminal sending order data and of the manufacturer terminal receiving said data, said data incorporating said first longitudinal profile (27).

27. The method according to claim 1, implemented by means of a system comprising firstly a client terminal installed beside a client and including computer means for recording and transmitting order data concerning the ophthalmic lens (20), said order data including data relating to the frame, and secondly a manufacturer terminal installed beside a manufacturer and including computer means for receiving and recording the order data transmitted by the client terminal, a shaper device for edging said fabricated ophthalmic lens, the device being designed to implement said blocking and edging step, said acquisition step comprising:

a determination step of the client determining a reference of the eyeglass frame (10); and an ordering step of the client terminal sending order data and of the manufacturer terminal receiving said data, said data incorporating said reference; and a searching step of the manufacturer terminal searching, in a database registry in which each record is associated with a type of eyeglass frame (10) and contains a reference for said frame and the first longitudinal profile (27) of the surround of said frame, for a record associated with the frame reference in question.

* * * * *

UNITED STATES PATENT AND TRADEMARK OFFICE

CERTIFICATE OF CORRECTION

PATENT NO. : 8,651,661 B2
APPLICATION NO. : 12/864673
DATED : February 18, 2014
INVENTOR(S) : Ahmed Haddadi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 876 days.

Signed and Sealed this
Twenty-ninth Day of September, 2015

Michelle K. Lee

Michelle K. Lee
*Director of the United States Patent and Trademark Office*